United States Patent [19]

Sarin et al.

[11] 4,446,936

[45] May 8, 1984

[54] MINING DRILL

[75] Inventors: Vinod K. Sarin, Lexington; Peter Oberhauser, Sudbury, both of Mass.

[73] Assignee: GTE Laboratories Incorporated, Waltham, Mass.

[21] Appl. No.: 346,968

[22] Filed: Feb. 8, 1982

[51] Int. Cl.[3] ..... E21B 10/62

[52] U.S. Cl. ..... 175/410; 175/418

[58] Field of Search ..... 175/410, 418, 320, 411, 175/415, 417, 327, 213

[56] References Cited

U.S. PATENT DOCUMENTS

| | | | |
|---|---|---|---|
| 3,415,332 | 12/1968 | Bower, Jr. | 175/410 |
| 4,165,790 | 8/1979 | Emmerich | 175/410 |
| 4,356,873 | 11/1982 | Dziak | 175/410 |
| 4,368,789 | 1/1983 | Orr et al. | 175/418 |

*Primary Examiner*—Stephen J. Novosad
*Assistant Examiner*—Hoang C. Dang
*Attorney, Agent, or Firm*—Robert E. Walter

[57] ABSTRACT

In a mine tool of the type having a drive body holding a bit, the drive body includes forwardly projecting flanges each having a bit engaging surface for transmitting torque to the bit and the bit includes an independent means for securing the bit to the drive body against forward separating movement.

2 Claims, 6 Drawing Figures

MINING DRILL

FIELD OF INVENTION

The present invention relates to a mining drill which is particularily useful for drilling coal mine roof bolt holes.

BACKGROUND OF INVENTION

Roof drills are used for drilling holes in rock in the roof of mines for installing roof bolts. The drills are typically in the form of a drive body having a bit at the forward end with a hard wear-resistant material, such as tungsten carbide rigidly secured to the bit.

U.S. Pat. No. 4,190,128 to Emmerich relates to a roof drill having openings in the bit which connect to a hole in the drive body for the passage of air and removal of detritus.

U.S. Pat. No. 3,032,129 to Fletcher et al relates to a drill bit wherein the air is drawn into the drive body through open portions on each side of the bit.

U.S. Pat. No. 3,434,552 to Bower, Jr. relates to a bit having a slot with a cutting insert loosely held within the slot for free endwise sliding movement relative to the slot.

SUMMARY OF INVENTION

During drilling it is desirable to remove detritus, which is comprised of dust, cuttings and bit fragments generated during drilling due to the drilling action of the cutting insert. Inadequate removal results in an increase in the torque required to rotate the mining drill. Suction is typically applied through a passage in the drive body so that detritus can be removed from the hole being drilled.

In accordance with the present invention, there is provided a mine drill for aiding the collection of detritus during drilling comprising a drive body being cylindrically shaped about an axis of rotation and having an axial passage for the flow of detritus, a bit mounted at the forward end of said drive body for movement about said axis of rotation, said bit comprising a body portion having a base portion with a pair of support lands projecting therefrom along an axial direction and an elongated insert having forwardly projecting cutting edges and a base surface secured to said base portion, said base surface lying in a plane substantially normal to the axis of rotation, each support land being offset said axis of rotation and secured to respective opposite sides of said insert whereby during rotation of said bit leading insert surfaces are substantially unobstructed and trailing insert surfaces are mounted to respective support lands, said insert having end portions extending in a radial direction outwardly of said base portion and said drive body, said drive body having a pair of forwardly projecting flanges forming diametrically opposed apertures, each aperture receiving a respective end portion, each flange having a trailing land facing a respective support land for disengageably transmitting substantially all of said torsional forces to said bit during drilling, and independent means for removably holding said bit from movement in an axial direction, a pair of air passages adapted for conveyance of detritus during drilling to said axial passage, each passage being formed on an opposite side of said bit.

DRAWINGS

DETAILED DESCRIPTION

Figure 1:
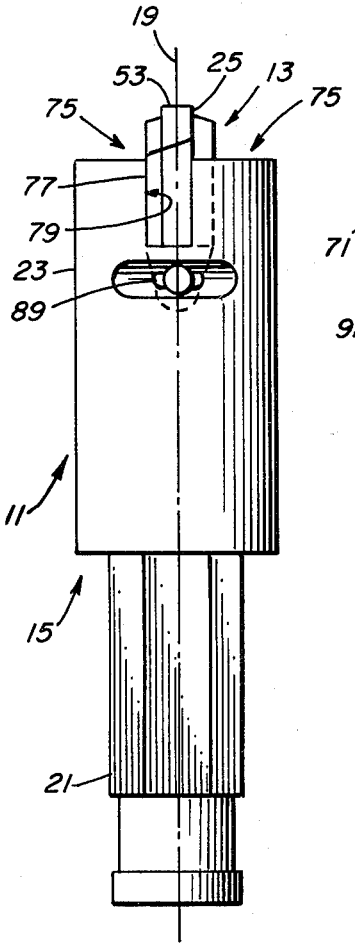
FIG. 1 is a side elevational view of the drill including bit mounted on the drive body.
Figure 4:
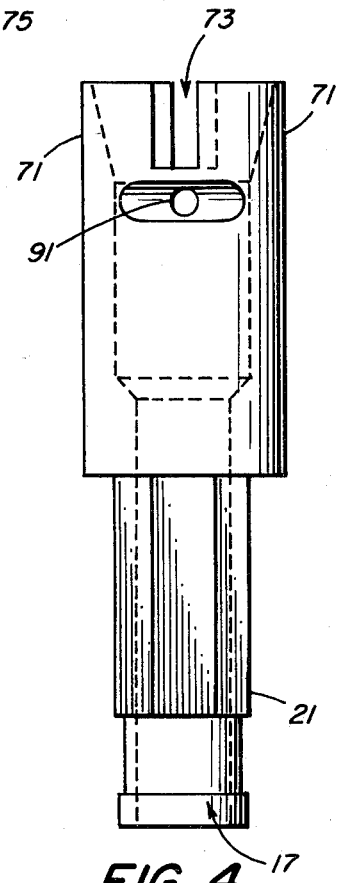
FIG. 4 is a side view of the drive body.
Figure 5:
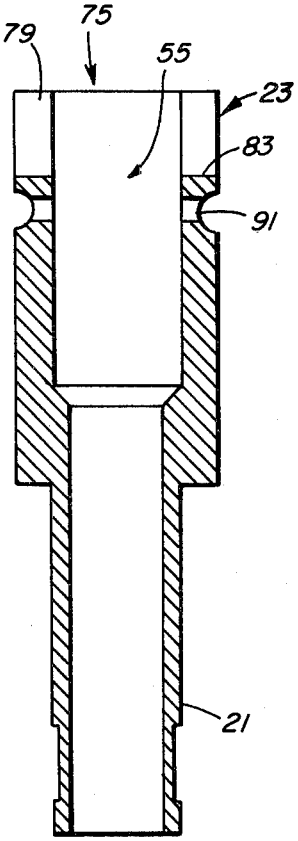
FIG. 5 is a sectional view of the drive body.
Figure 3:
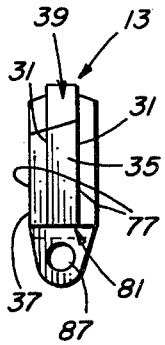
FIG. 3 is an end view of the bit of FIG. 2.
Figure 2:
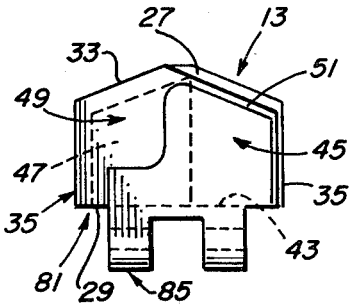
FIG. 2 is a side view of the bit.
Figure 6:
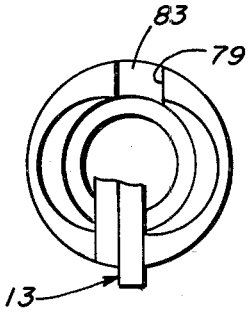
FIG. 6 is an end elevational view of the drive body.

FIG. 1 generally illustrates a mining drill 11 comprising a bit 13 mounted on a drive body 15 having an axial passage 17 for the flow of detritus from the cutting area. The drive body 15, is cylindrically shaped and capable of being mounted for movement about an axis of rotation 19. As illustrated in FIG. 1, the rearward end 21 has a hexagonal shape of reduced dimension forming a socket end which can be attached to another drive body having an air passage with a mating hexagonal recess. Multiple drive bodies can be conveniently connected to a drilling machine and vacuum source of a conventional type.

The terms forward and rearward are used for convenience of description and should not be taken as limiting the scope of the invention. For purposes of this description, forward generally refers to axial direction in which the drill is advanced during cutting and rearward is the opposite direction.

A bit 13 which is attached to the forward end 23 of the drive body includes an insert 25 rigidly attached thereto for movement about the axis of rotation 19. The insert 25 has forwardly projecting lands 27 which form an angle of from about 135° to about 145° and a rectangular base surface 29. Side surfaces 31 extend from respective ends of the base surface 29 toward the forward lands 27 intermediate the end portions 35 of the insert 25. The forward lands 27 meet substantially at the axis of rotation 19 and slope downwardly from the cutting edges in opposite directions on either side of the point at an angle of about 8° to about 12°. The cutting edges 33 are located above the two diagonally opposite corners of the rectangular base surface 29.

During rotation of the insert 25 during cutting, the cutting edges lead the insert 25 so as to make primary cutting contact with the work, i.e. roof rock. For purposes of this description leading surfaces or edges are intended to refer to edges or surfaces which are first presented to the work in the direction of rotation.

The body portion 37 of the bit 13 includes a slot 39 which extends diametrically across the body portion 37 so as to form flat support surface 43 normal to the axis of rotation 19 of the bit 13. The body portion 37 further includes a pair of support lands 45 which project forwardly of the flat surface 43 in the axial direction so as to form vertical surfaces 47 which are the respective inner surfaces of the slot 39. As illustrated in detail in the drawings, a pair of vertical surfaces 47 are positioned in diagonally opposite sides of the slot 39. Each of the respective support lands 45 is offset the axis of rotation 19 and secured to respective opposite side surfaces 31 of the insert 25 whereby during rotation of the bit 13, leading insert surfaces 49 are substantially unobstructed and trailing insert 51 surfaces are mounted to respective support lands 45. The body portion 37 of the bit 13 may be conveniently formed by forging or precision casting and the slot 39 subsequently milled.

The insert 25 is mounted to the body portion 37 so that end portions 35 extend through the slot 39 in a radial direction outwardly of the body portion 37 and the drive body 15. Preferably the point 53 of the insert 25 is axially aligned with the axis of rotation 19 and the insert 25 is fixedly held in position in the slot 39 with the base surface 29 secured to the flat surface 43 and respective side surfaces 31 secured to respective vertical surfaces 47. Typically the securing is by brazing. The radial projection of the end portions 35 beyond the support lands 45 and the drive body 15 creates a hole slightly larger than the dimensions of the drive body 15. The radial outer dimensions of the lands 45 preferably match the outer dimensions of the drive body 15. Thus, during drilling, air is supplied or drawn into the drill hole by suction along the exterior of the drive body 15.

The drive body 15 includes a pair of forwardly projecting flanges 71 forming diametrically opposed apertures 73. Each of the apertures 73 is adapted to receive one of the respective end portions 35. The flanges 71 which are diametrically opposed extend in a direction forward of the plane of the base surface 29 of the insert 25 when the bit 13 is mounted to the drive body 15. Each of the flanges 71 is spaced from a respective side surface 31 so as to form a respective air passage 75 adapted for the conveyance of detritus during drilling to the axial passage 17. As illustrated in FIGS. 2–6, each of the apertures 73 are sufficiently large along the circumferential direction to accomodate the portion of respective support lands 45 which project in the radial direction beyond the inner surface 55.

As illustrated in the drawings, the flanges 71 are preferably an extension of the tubular shape of the drive body 15 and are formed by the inner surface 55 and outer cylindrical shape. The flanges 71 have a forward end in a plane normal to the axis of rotation. Each of the flanges 71 extend forwardly to a position intermediate to the insert base surface 29 and the most rearward position of the forward lands or cutting lands 27. From a side view of the insert 25, the most rearward position of the cutting lands 27 is along a plane passing through the most rearward portions of each of the cutting lands 27. Preferably the upper surface of the flange which corresponds to the forward end 23 is forwardly closer to the most rearward portion of the cutting lands 27 than midway the plane of the base surface 29 and the plane of the cutting lands 27. The air passages 75 are thusly positioned closely adjacent the cutting lands 27 of the bit 13 so that air sucked in adjacent the exterior of the drive body 15 preferably reverses direction, increases velocity and forces detritus through the air passages 75.

In the area adjacent the cutting lands 27, the respective air passages 75 in diametrically opposed quadrants are formed by respective unobstructed leading insert surfaces 49, the interior surface of the respective flanges 71, and the outer surface 77 of the respective support lands 45. Each of the respective support lands 45 which are in diametrically opposed quadrants have outwardly facing surfaces 77 that are within the confines of the drive body 15. Preferably each of the support lands 45 extend along the face of the insert 25 from an area spaced from the end of the insert 25 to about the midpoint of the insert 25.

In accordance with the principles of the present invention, each of the flanges 71 include a trailing land 79 facing a respective support land 45 for disengagably transmitting substantially all of said torsional forces to the bit 13 during drilling. The bit 13 is provided with a means independent of the means for applying torsional forces to removably hold the bit 13 from movement in a forward axial direction relative to the drive body 15.

The torque from the drive body 15 is transmitted to the bit 13 by engagement of a respective trailing land 79 with the respective outer surface 77 of the respective support land 45. The trailing land 79 extends forwardly and along a plane corresponding to the plane of the outer surface 77 so that sufficient surface is in engagement to transmit the torque. The bottom surface 81 of the bit 13 engages and is supported by a lower surface 83 of the respective aperture 73 so that the rearward forces on the bit 13 during drilling caused by the forward thrust of the bit 13 against the work is transmitted to the drive body 15. The above description with respect to one aperture 73 also applies to the other aperture 73 due to similarity of construction.

The body portion 37 includes an independent means for detachably securing the bit 13 to the drive body 15 so that the bit 13 remains in place when being withdrawn from the drill hole and easily changed when worn. One such detachable securing means as illustrated in the drawings includes a depending member 85 projecting rearwardly from the bottom surface 81 having an opening 87 therein. A pin 89 passing through the opening 87 and holes 91 in the drive body 15 prevent forward withdrawal of the bit 13. The bit 13 is provided with two such members although one is sufficient. In another embodiment (not shown), the bit and drive body are provided with complimentary snap lock and opening engageable by the lock. The lock includes a latch which is spring loaded and retracts when the bit is inserted in the drive body. When the opening is in alignment with the latch, the latch moves to engage the opening due to its normal bias in the direction. To remove the bit, the latch is depressed inwardly until the latch is interior the cylindrical body and the bit may be removed.

INDUSTRIAL APPLICABILITY

The mining drills are particularily useful for drilling coal mine roof bolt holes.

We claim:

1. A mine drill for aiding the collection of detritus during drilling comprising a drive body being cylindrically shaped about an axis of rotation and having an axial passage for the flow of detritus, a bit mounted at the forward end of said drive body for movement about said axis of rotation, said bit comprising a body portion having a base portion with a pair of support lands projecting therefrom along an axial direction and an elongated insert having forwardly projecting cutting edges and a base surface secured to said base portion, said base surface lying in a plane substantially normal to the axis of rotation, each support land being offset said axis of rotation and secured to respective opposite sides of said insert whereby during rotation of said bit leading insert surfaces are substantially unobstructed and trailing insert surfaces are mounted to respective support lands, said insert having end portions extending in a radial direction outwardly of said base portion and said drive body, said drive body having a pair of forwardly Projecting flanges forming diametrically opposed apertures, each aperture receiving a respective end portion, each flange having a trailing land facing a respective support land for disengageably transmitting substantially all of said torsional forces to said bit during drilling, and independent means for removably holding said bit from movement in an axial direction, each flange being an extension of the tubularly shaped drive body and extending forwardly of said plane and being spaced from opposite sides of said insert to form a pair of unobstructed air passages adapted for conveyance of detritus during drilling to said axial passage, each passage being formed on an opposite side of said bit.

2. A mine drill according to claim 1 wherein said independent means comprises a member having an opening therein, said member projecting rearwardly from said body portion, a pin passing through said opening and said body portion for retaining said bit.

* * * * *